US009627121B2

(12) United States Patent
Peterson et al.

(10) Patent No.: US 9,627,121 B2
(45) Date of Patent: Apr. 18, 2017

(54) SOLENOID ROBUST AGAINST MISALIGNMENT OF POLE PIECE AND FLUX SLEEVE

(71) Applicant: FLEXTRONICS AUTOMOTIVE INC., Milpitas, CA (US)

(72) Inventors: Matthew Peterson, Ada, MI (US); Hamid Najmolhoda, Grand Rapids, MI (US)

(73) Assignee: Flextronics Automotive, Inc., San Jose, CA (US)

( * ) Notice: Subject to any disclaimer, the term of this patent is extended or adjusted under 35 U.S.C. 154(b) by 14 days.

(21) Appl. No.: 14/288,805

(22) Filed: May 28, 2014

(65) Prior Publication Data

US 2015/0348691 A1 Dec. 3, 2015

(51) Int. Cl.

| | |
|---|---|
| ***H01F 3/00*** | (2006.01) |
| ***H01F 7/121*** | (2006.01) |
| ***H01F 7/08*** | (2006.01) |
| ***H01F 7/16*** | (2006.01) |

(52) U.S. Cl.

CPC ..... *H01F 7/121* (2013.01); *H01F 7/08* (2013.01); *H01F 7/081* (2013.01); *H01F 7/1607* (2013.01); *H01F 2007/085* (2013.01)

(58) Field of Classification Search

CPC ..... F16B 13/044; F16K 31/08; F02M 25/07; F02M 51/061

USPC ..... 335/281

See application file for complete search history.

(56) References Cited

U.S. PATENT DOCUMENTS 4,643,227 A * 2/1987 Suzuki ..... B62D 6/00 137/625.38
4,662,605 A * 5/1987 Garcia ..... F16K 31/0613 137/14
5,127,585 A * 7/1992 Mesenich ..... F02M 51/0614 239/585.3
5,460,146 A * 10/1995 Frankenberg ..... F02M 25/0772 123/568.21
5,460,349 A * 10/1995 Campbell ..... F16K 3/26 236/75
5,467,962 A * 11/1995 Bircann ..... 251/129.15
5,513,832 A * 5/1996 Becker ..... F16K 31/0624 137/82
5,547,165 A * 8/1996 Brehm ..... F16H 61/0251 251/129.08
5,588,414 A * 12/1996 Hrytzak ..... F02M 25/0789 123/568.26
5,593,132 A * 1/1997 Hrytzak ..... F02M 25/0756 251/129.15
5,611,370 A * 3/1997 Najmolhoda ..... F16K 31/0613 137/625.61
5,687,698 A * 11/1997 Mastro ..... F02M 25/0772 123/568.26

(Continued)

FOREIGN PATENT DOCUMENTS

WO 20130116031 A1 8/2013

*Primary Examiner* — Shawki S Ismail
*Assistant Examiner* — Lisa Homza
(74) *Attorney, Agent, or Firm* — Volpe and Koenig, P.C.

(57) ABSTRACT

An electromagnetic solenoid is disclosed. The solenoid includes a coil, a bobbin, a flux sleeve, an armature, and a pole piece, arranged in such a way that the solenoid is robust against misalignment of the pole piece with the flux sleeve. The configuration facilitates the integration of either the pole piece or the flux sleeve into a hydraulic circuit.

20 Claims, 2 Drawing Sheets

(56) References Cited

U.S. PATENT DOCUMENTS 5,752,689 A * 5/1998 Barkhimer ..... F16K 31/0665 239/585.4
5,779,220 A * 7/1998 Nehl ..... F02M 25/0756 123/568.26
5,878,779 A * 3/1999 Bircann ..... F02M 25/0772 123/568.26
5,915,626 A * 6/1999 Awarzamani ..... F02M 31/125 137/341
5,944,262 A * 8/1999 Akutagawa ..... F02M 51/0671 239/585.1
5,984,259 A * 11/1999 Najmolhoda ..... G05D 16/2093 137/625.64
5,996,910 A * 12/1999 Takeda ..... F02M 51/0614 239/585.1
6,012,655 A * 1/2000 Maier ..... F02M 51/0614 239/533.3
6,199,776 B1 * 3/2001 Andorfer ..... F02M 51/0667 239/585.1
6,321,767 B1 * 11/2001 Seid ..... F16K 31/0613 137/15.21
6,405,743 B1 * 6/2002 Spryshak ..... F16K 31/0689 137/1
6,408,883 B2 * 6/2002 Motoki ..... 137/625.64
6,498,416 B1 * 12/2002 Oishi ..... F02M 51/0614 310/214
6,501,359 B2 12/2002 Matsusaka et al.
6,598,852 B2 * 7/2003 Tomoda ..... F16K 31/0631 251/129.14
6,601,822 B2 * 8/2003 Tachibana ..... F16K 31/0613 137/625.69
6,679,435 B1 * 1/2004 Noller ..... F02M 51/061 239/5
6,796,322 B2 * 9/2004 Sen ..... G05D 16/2013 137/625.65
6,837,477 B2 * 1/2005 Mayr ..... G05D 16/2013 251/129.07
6,877,717 B2 * 4/2005 Collins ..... B60T 8/363 251/129.15
6,953,186 B2 * 10/2005 Kaneda ..... F16K 39/04 251/129.15
7,014,168 B2 * 3/2006 Shimura ..... F16K 31/0613 251/129.15
7,468,647 B2 * 12/2008 Ishibashi ..... F16K 31/0613 251/129.15
7,581,302 B2 * 9/2009 Tyler ..... F16K 31/0648 251/129.15
8,134,436 B2 * 3/2012 Yasoshima ..... H01F 7/127 251/129.15
8,154,370 B2 * 4/2012 Ishibashi ..... H01F 7/081 251/129.15
8,347,918 B2 * 1/2013 Shimizu ..... F04B 17/046 137/596.16
8,556,232 B2 * 10/2013 Oikawa ..... F16K 31/0613 251/129.01
8,757,587 B2 * 6/2014 Miura ..... F16K 31/06 251/129.15
8,928,439 B2 * 1/2015 Stitz ..... H01F 7/081 335/281
8,973,895 B2 * 3/2015 Thomas ..... F01N 3/2066 137/625.48
9,076,583 B2 * 7/2015 Ando ..... H01F 7/127
2004/0056227 A1 * 3/2004 Mayr ..... G05D 16/2013 251/129.15
2006/0180783 A1 * 8/2006 Tackes ..... F16K 3/26 251/129.15
2007/0023722 A1 * 2/2007 Oishi ..... F16K 11/07 251/129.15
2012/0291900 A1 11/2012 Mizui

* cited by examiner

SOLENOID ROBUST AGAINST MISALIGNMENT OF POLE PIECE AND FLUX SLEEVE

FIELD OF INVENTION

Embodiments of the present invention generally relate to electromagnetic solenoids.

BACKGROUND

In some cases it is desirable to shunt the magnetic field generated by a coil in an electromagnetic solenoid. Known electromagnetic solenoids achieve this by providing a radial groove in the outside surface of a pole piece adjacent to a flux sleeve. When the coil is energized, the magnetic field in the area of the radial groove will saturate and act as an air gap.

Current electromagnetic solenoids provide the radial groove on a hollow cylindrical end portion of the pole piece. As the armature is displaced in the flux sleeve towards the pole piece, it is guided to fit within the hollow interior of the cylindrical end portion. However, this configuration requires precise alignment of the flux sleeve with the pole piece to prevent contact between the armature and the interior of the pole piece. Contact is known to increase friction, and possibly preventing proper function of the solenoid. The precise alignment required to prevent contact slows production and may increase reject rate if the alignment is not properly maintained.

Accordingly, a need exists for an electromagnetic solenoid that less sensitive to misalignment between the flux sleeve and the pole piece.

SUMMARY

Embodiments of an electromagnetic solenoid are provided herein. In an embodiment, an electromagnetic solenoid comprises a coil for generating a magnetic force when energized and a bobbin having a tubular center portion and end flanges between which the coil is wound. A tubular flux sleeve is at least partially disposed within the center portion of the bobbin with an armature disposed coaxially within an interior portion of the flux sleeve and supported for axial displacement between a first position when the coil is not energized and a second position when the coil is energized. A pole piece is at least partially disposed within an interior portion of the bobbin in an abutting relationship with a first end of the flux sleeve. The flux sleeve has a circumferential groove formed in an outer surface adjacent to the first end.

Other and further embodiments of the present invention are described below.

BRIEF DESCRIPTION OF THE DRAWINGS

Embodiments of the present invention, briefly summarized above and discussed in greater detail below, can be understood by reference to the illustrative embodiments of the invention depicted in the appended drawings. It is to be noted, however, that the appended drawings illustrate only typical embodiments of this invention and are therefore not to be considered limiting of its scope, for the invention may admit to other equally effective embodiments.

Figure 1:
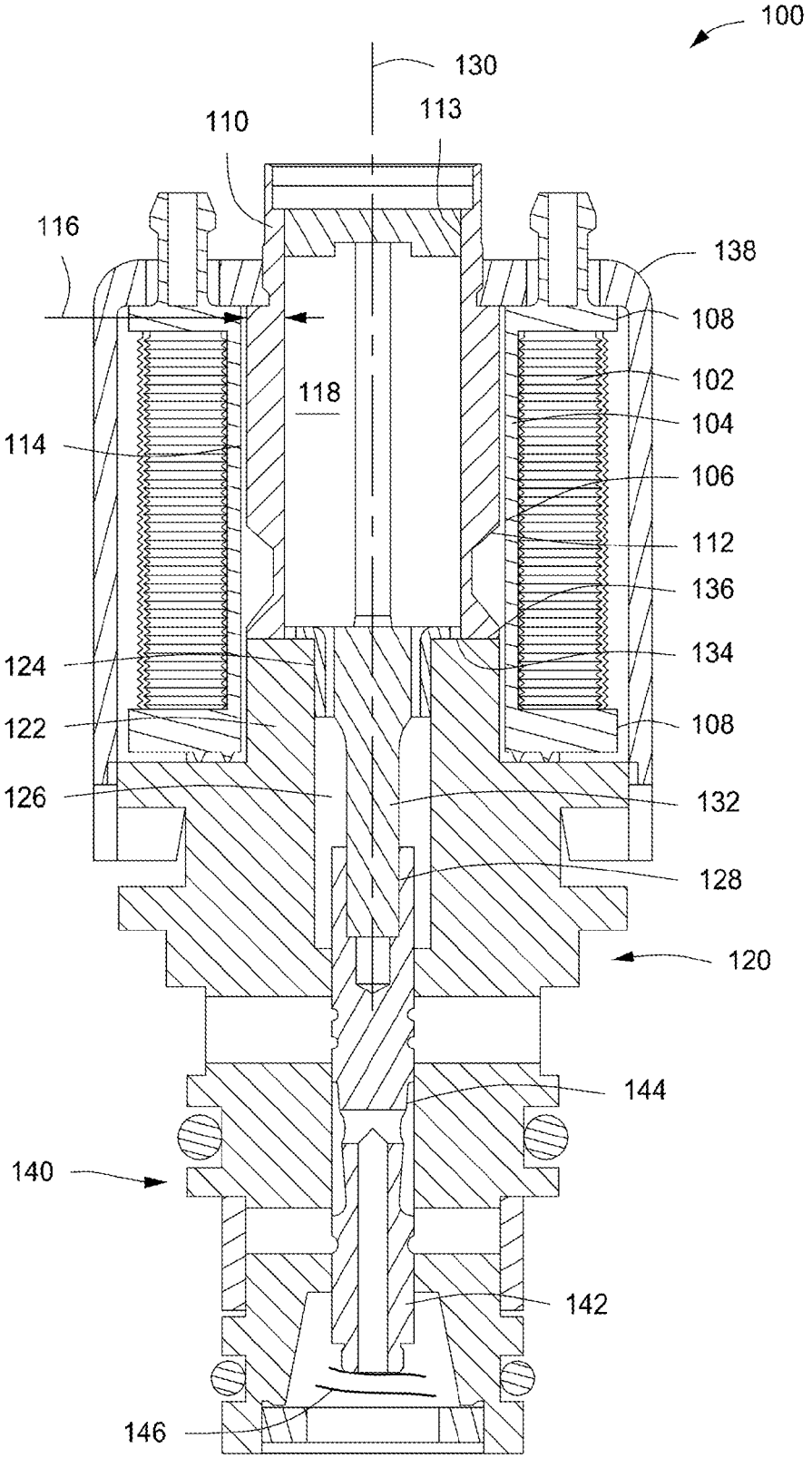
FIG. 1 depicts a solenoid according to an embodiment of the present invention.

To facilitate understanding, identical reference numerals have been used where possible to designate identical elements that are common in the figures. The figures are not drawn to scale and may be simplified for clarity. It is contemplated that elements and features of one embodiment may be beneficially incorporated in other embodiments without further recitation.

DETAILED DESCRIPTION

FIG. 1 depicts a solenoid 100 in accordance with an embodiment of the present invention. The solenoid 100 comprises a magnetic coil 102 helically wound around the tubular center portion 106 of a bobbin 104 between end flanges 108. The coil 102 is configured so that when it is energized with an electrical current, a magnetic force is generated in the armature 118 due to the magnetic field of the solenoid 100.

A magnetic tubular flux sleeve 110, with an outer surface 114 and an inner surface 113, is coaxially aligned with the bobbin 104 and disposed at least partially within the hollow of center portion 106. A circumferential groove 112 is formed in the outer surface 114 adjacent to one end of the flux sleeve 110. The contour of the groove 112 is chosen to shunt the magnetic flux in a radial direction. The wall thickness 116 between the inner and outer surfaces 113, 114 is locally reduced at the groove 112. The area of the reduced wall thickness will saturate when the coil is energized and act as an air gap in the magnetic field. In this disclosure, "saturate" and forms thereof are used to describe the condition in a material in which an increase in the magnetic field will not produce an increase in the magnetic flux of the material. In this case, the area of the circumferential groove 112 becomes saturated at a lower magnetic field than the portions of flux sleeve 110 with the unmodified wall thickness 116.

A hollow tubular armature 118 is coaxially disposed in the interior portion of the flux sleeve 110. The armature 118 is supported for axial displacement within the flux sleeve 110 between at least a first position when the coil 102 is not energized and a second position when the coil 102 is energized as shown in FIG. 1. The armature 118 is formed from a magnetic material and may include a non-magnetic coating (e.g., nickel) on at least the outer circumferential surface. The armature 118 is sized to fit in the flux sleeve 110 with minimal clearance to maximize the magnetic efficiency of the solenoid 100.

In the embodiment of FIG. 1, the solenoid 100 includes a pole piece 120 in an abutting relationship with an end of the flux sleeve 110. A flat radial surface 134 of the pole piece 120 is positioned adjacent to and abutting a flat radial surface 136 of the flux sleeve 110. A portion 122 of the pole piece 120 extends at least partially into the interior portion of the flux sleeve 110. An axial bore 126 extends at least partially through the pole piece 120. In some embodiments the bore 126 is axially aligned with the flux sleeve 110 and the armature 118, while in other embodiments, the bore 126 is not axially aligned with flux sleeve 110 or the armature 118.

A non-magnetic armature stop 124 is coupled to the end of the pole piece 120 adjacent to the flux sleeve 110, for example by press fitting a portion of the armature stop 124 in the bore 126. Axial displacement of the armature 118 is limited in a first direction (toward the pole piece 120) by the armature stop 124 which prevents the armature 118 from contacting the pole piece 120 (sometimes referred to as "latching").

A pin 128 is disposed within the bore 126 of the pole piece 120 and supported for axial displacement within an open interior portion of the armature stop 124 and at least a portion of the bore 126. An end of the pin 128 abuts an end of the armature 118 so that displacement of the armature from a first position (corresponding to a de-energized coil condition) to a second position (corresponding to an energized coil condition) displaces the pin 128 a corresponding amount.

A case 138 disposed around the solenoid 100 adjacent to outer portions of the bobbin 108 and the pole piece 120 captures the components of the solenoid 100 and limits movement between the bobbin 108, the flux sleeve 110 and the pole piece 120.

The inventor has noted that some known solenoids include an undercut in a tubular portion of the pole piece extending into the flux sleeve. The flux sleeve is axially aligned with the tubular portion of the pole piece, with the flux sleeve and tubular portion in contact with each other. In at least one condition, the armature extends through the flux sleeve and is received into the interior of the tubular portion of the pole piece. Because of design factors, it is desirable to maintain a minimal gap between the armature and the inner walls of the flux sleeve and the inner walls of the tubular pole piece portion. Great effort is required to maintain axial alignment of the flux sleeve and the pole piece to allow the armature to move unhindered between the interior of the flux sleeve and the interior of the pole piece. Friction between the armature and the inner wall of the tubular portion of the pole piece reduces the efficiency and response time of the solenoid.

Some known solenoids increase the diameter of the tubular portion of the pole piece in order to compensate for manufacturing inaccuracies. This increases the clearance between the armature and the inner wall to allow free axial movement. However the increased gap decreases the magnetic efficiency of the solenoid, negatively affecting performance.

The inventor has observed that by placing the circumferential groove 112 on the flux sleeve 110, a number of benefits are realized. Because the flux sleeve 110 is tubular in form, the inner passage may be formed with tight tolerances in a more economical manner than known flux sleeves. In contrast, the interior passage of some known flux sleeves are blind holes or counter bores which are more difficult to hold to tight tolerances.

Because the armature 118 does not extend from the flux sleeve 110 to be received into the pole piece 120 in the present disclosure, precise alignment of the flux sleeve 110 with the pole piece 112 is not required. In the inventive solenoid, the axis 130 of the armature 118 need not be aligned with the axis 132 of the pin 128 in order to advance the pin 128 in response to linear displacement of the armature 110. The armature 110 may be aligned for free axial movement within the flux sleeve 110. The pin 128 is positioned in the pole piece 120 for free axial movement, independent of the position of the flux sleeve 110.

A benefit realized by this design is the reduction, or elimination, of friction and hysteresis due side loading of the armature 110. In some known solenoids, as the armature extends into the pole piece, and any misalignment between the armature and the pole piece causes contact between the armature and the pole piece leading to undesirable friction and hysteresis.

An additional benefit, as illustrated in FIG. 1, the pole piece 120 can be formed integrally with a nozzle 140. For purposes of this specification, "integrally" or forms thereof, means formed from one continuous piece of material unless the context dictates otherwise. Because radial flat faces 134, 136 of the pole piece 120 and the flux sleeve 110, respectively, are abutted together, obviating precise alignment of the flux sleeve 110 and the pole piece 120, either of the flux sleeve 110 or the pole piece 120 may be integrated vie a feature (e.g., nozzle 140) into a hydraulic circuit. This may beneficially reduce the number of components and the cost to manufacture the inventive solenoid over known solenoids.

The nozzle 140 of FIG. 1 includes a spool 142 disposed at least partially within a passage 144. One end of the spool 142 is coupled to an end of the pin 128, for example by a press fit, and supported for axial displacement with the pin 128. A resilient member 146 is disposed in the nozzle 140 and compressed by the opposite end of the spool 142 when the armature 118 is in the second position (corresponding to an energized condition of the coil 102) as shown. When the coil 102 is de-energized, the armature 118 is urged into the first position by the compressed resilient member 146 as it returns to an extended configuration.

When the coil 102 of the solenoid 100 is in a de-energized condition, the armature 118 and the pin 128 are in the retracted position. The embodiment of FIG. 1 is sometimes referred to as a "normally low" solenoid.

Figure 2:
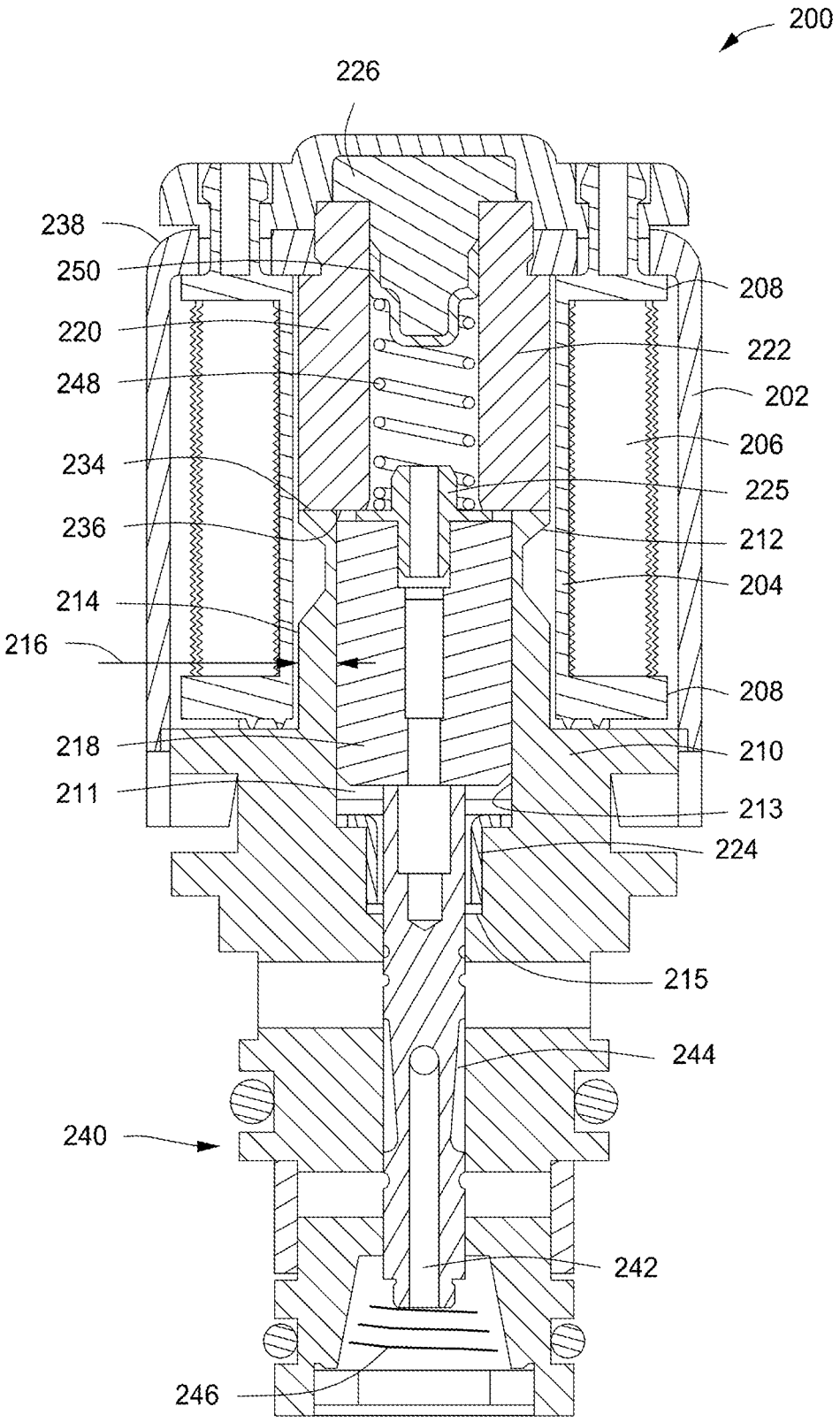
FIG. 2 depicts a solenoid according to an embodiment of the present invention.

In the embodiment illustrated in FIG. 2, the solenoid 200 comprises a magnetic coil 202 helically wound around the tubular center portion 206 of a bobbin 204 between end flanges 208.

The solenoid 200 includes a magnetic tubular flux sleeve 210, with an outer surface 214 and an inner surface 213, coaxially aligned with the bobbin 204 and disposed at least partially within the hollow of the center portion 206. The flux sleeve 210 has a first interior passage 211 formed at one end and a smaller interior passage 215 formed from the other end of the flux sleeve 210 into the first passage 211. A circumferential groove 212 is formed in the outer surface 214 adjacent to one end of the flux sleeve 210. The contour of the groove 212 is chosen to shunt the magnetic flux in a radial direction. The wall thickness 216 between the inner and outer surfaces 213, 214 is locally reduced at the groove 212. The area of the reduced wall thickness will saturate when the coil is energized and act as an air gap in the magnetic field.

A hollow tubular armature 218 is coaxially disposed in the first interior passage 211 of the flux sleeve 210. The armature 218 is supported for axial displacement within the flux sleeve 210 between at least a first position when the coil 202 is not energized and a second position when the coil 202 is energized as shown in FIG. 2. The armature 218 is of similar composition as armature 118. The armature 218 is sized to fit in the flux sleeve 210 with minimal clearance to maximize the magnetic efficiency of the solenoid 200.

In the embodiment of FIG. 2, the solenoid 200 includes a hollow tubular pole piece 220 in an abutting relationship with an end of the flux sleeve 210. A flat radial surface 234 of the pole piece 220 is positioned adjacent to a flat radial surface 236 of the flux sleeve 210. A portion 222 of the pole piece 220 extends at least partially into the interior portion of the flux sleeve 210. An axial bore 226 extends through the pole piece 220. In some embodiments the bore 226 is axially aligned with the flux sleeve 210 and the armature 218, while in other embodiments, the bore 226 is not axially aligned with flux sleeve 210 or the armature 218.

A case 238 disposed around the solenoid 200 adjacent to outer portions of the bobbin 208 and the pole piece 220 captures the components of the solenoid 200 and limits movement between the bobbin 208, the flux sleeve 210 and the pole piece 220.

A non-magnetic first armature stop 224 is coupled to the end of the flux sleeve 210, for example by press fitting a portion of the armature stop 224 into the interior passage 213. Axial displacement of the armature 218 is limited in a first direction (away from the pole piece 220) by the armature stop 224.

Axial displacement of the armature 218 in a second direction (toward the pole piece 220) is limited by a non-magnetic second armature stop 225 coupled to the armature 218, for example by press fitting a protrusion on the armature stop 225 into the open central portion of the armature 218. The second armature stop 225 prevents the armature 218 from "latching" to the pole piece 220.

A resilient member 248, for example a compression spring, is disposed in the axial bore 226 with one end abutting a plug 250 fixed to the solenoid 200 and the other end abutting the second armature stop 225. The resilient member 248 generates a force urging the armature 218 in a direction away from the pole piece 222 and into the first position corresponding to a de-energized coil 202. When the coil 202 is energized, the magnetic force generated by the coil is sufficient to overcome the force of the resilient member 248 and the armature is pulled in a direction of the pole piece 222 (corresponding to the second position).

The embodiment of FIG. 2 offers benefits similar to those realized in the embodiment of FIG. 1. For example, the armature remains within the interior portion of the flux sleeve 210 thereby obviating the need to accurately align the axis of the pole piece 220 with the axis of the flux sleeve 210.

The embodiment also facilitates the integration of the flux sleeve 210 with a portion of the hydraulic circuit, nozzle 240. As illustrated, the nozzle includes a spool 242 disposed at least partially within a passage 244. One end of the spool 242 abuts against an end of the armature 218 so that displacement of the armature 218 from the second position to the first position displaces the spool 242 a corresponding amount. A resilient member 246 is disposed in the nozzle 240 and compressed by an opposite end of the spool 242 when the armature 218 is in the first position (corresponding to a de-energized condition of the coil 102). When the coil 202 is energized, the armature 218 is urged into the second position by the magnetic force of the coil 202 and by the resilient member 246 as it returns to an extended configuration.

When the coil 202 of the solenoid 200 is in a de-energized condition, the armature 218 is in the extended position. The embodiment of FIG. 2 is sometimes referred to as a "normally high" solenoid.

Thus embodiments of a solenoid robust against misalignment of the pole piece and flux sleeve are provided herein. The inventive solenoid may advantageously reduce manufacturing cost by facilitating assembly and thereby reducing assembly time. The embodiments also provide for integrating either the pole piece or the flux sleeve into the hydraulic circuit further reducing manufacturing costs by minimizing the number of components.

What is claimed is:

1. An electromagnetic solenoid comprising:

a coil for generating a magnetic force when energized;

a bobbin having a tubular center portion and end flanges between which the coil is wound;

a tubular flux sleeve at least partially disposed within a center portion of the bobbin, the tubular flux sleeve having a first radial surface;

an armature disposed coaxially within an interior portion of the flux sleeve and supported for axial displacement between a first position when the coil is not energized and a second position when the coil is energized;

a pole piece at least partially disposed within an interior portion of the bobbin, the pole piece having a second radial surface substantially parallel to and abutting the first radial surface of the tubular flux sleeve; and a non-magnetic armature stop coupled to the end of the pole piece, disposed between the armature and the pole piece, configured to prevent the armature from contacting the pole piece, wherein the first radial surface of the tubular flux sleeve and the second radial surface of the pole piece abut within the interior portion of the bobbin; and the flux sleeve has a circumferential groove formed in an outer surface adjacent to the first end, the circumferential groove defined by a first wall of the flux sleeve, a second wall of the flux sleeve and a third wall of the flux sleeve extending between the first wall and the second wall.

2. The electromagnetic solenoid of claim 1, further comprising a pin supported for axial displacement in an axial bore of the pole piece.

3. The electromagnetic solenoid of claim 2, wherein a first end of the pin abuts a first end of the armature so that displacement of the armature from the first position to the second position displaces the pin a corresponding amount.

4. The electromagnetic solenoid of claim 2, wherein the axial bore is concentric with the flux sleeve.

5. The electromagnetic solenoid of claim 2, further comprising a nozzle integral with the pole piece.

6. The electromagnetic solenoid of claim 5, further comprising a spool disposed at least partially within the nozzle and supported for axial displacement.

7. The electromagnetic solenoid of claim 6, wherein a first end of the spool is coupled to a second end of the pin so that displacement of the pin causes displacement of the spool.

8. The electromagnetic solenoid of claim 7, further comprising a resilient member disposed in the nozzle and compressed when the coil is energized and extended when the coil is not energized.

9. The electromagnetic solenoid of claim 8, wherein the resilient member urges the spool in a direction corresponding to the first position of the armature when the resilient member is in an extended state.

10. An electromagnetic solenoid comprising:

a coil for generating a magnetic force when energized;

a bobbin having a tubular center portion and end flanges between which the coil is wound a tubular flux sleeve at least partially disposed within a center portion of the bobbin, wherein the tubular flux sleeve having a first radial surface, and the tubular flux sleeve has a circumferential groove formed in an outer surface adjacent to the first end, the circumferential groove defined by a first wall of the flux sleeve, a second wall of the flux sleeve and a third wall of the flux sleeve extending between the first wall and the second wall;

an armature disposed coaxially within an interior portion of the flux sleeve and supported for axial displacement between a first position when the coil is not energized and a second position when the coil is energized;

a pole piece at least partially disposed within an interior portion of the bobbin, the pole piece having a second radial surface substantially parallel to and abutting the first radial surface of the tubular flux sleeve;

a first non-magnetic armature stop coupled to the end of the pole piece, disposed between the armature and the pole piece, configured to prevent the armature from contacting the pole piece; and first resilient member disposed in an axial bore, wherein a first end of the first resilient member is fixed against axial displacement and a second end of the first resilient member abuts the first non-magnetic armature stop, wherein the first radial surface of the tubular flux sleeve and the second radial surface of the pole piece abut within the interior portion of the bobbin; and displacement of the armature from the first position to the second position displaces the second end of the first resilient member a corresponding amount.

11. The electromagnetic solenoid of claim 10, further comprising a nozzle integral with the tubular flux sleeve.

12. The electromagnetic solenoid of claim 11, further comprising a spool disposed at least partially in a bore in the nozzle and supported for axial displacement.

13. The electromagnetic solenoid of claim 12, wherein the bore in the nozzle is concentric with the flux sleeve.

14. The electromagnetic solenoid of claim 12, wherein a first end of the spool abuts a first end of the armature so that displacement of the armature from the second position to the first position displaces the spool a corresponding amount.

15. The electromagnetic solenoid of claim 14, wherein the second resilient member in a compressed state urges the spool in a direction corresponding to the second position of the armature.

16. The electromagnetic solenoid of claim 12, further comprising a second resilient member disposed in the nozzle and in a compressed state when the coil is not energized and in an extended state when the coil is energized.

17. The electromagnetic solenoid of claim 11 further comprising a second non-magnetic armature stop disposed between the armature and the tubular flux sleeve, configured to prevent the first end of the armature from contacting the tubular flux sleeve.

18. The electromagnetic solenoid of claim 11 further comprising a plug, wherein the plug abuts the first end of the first resilient member.

19. The electromagnetic solenoid of claim 11, wherein the tubular flux sleeve further comprises a first interior passage formed at one end of the tubular flux sleeve and a smaller interior passage formed from the other end of the tubular flux sleeve connected to the first interior passage and having a smaller radial diameter than the radial diameter of the first interior passage, wherein the armature is disposed coaxially within the first interior passage and is not disposed coaxially within the smaller interior passage.

20. The electromagnetic solenoid of claim 10 comprising:

a coil for generating a magnetic force when energized;

a bobbin having a tubular center portion and end flanges between which the coil is wound a tubular flux sleeve at least partially disposed within a center portion of the bobbin, wherein the tubular flux sleeve having a first radial surface, and the tubular flux sleeve has a circumferential groove formed in an outer surface adjacent to the first end, the circumferential groove defined by a first wall of the flux sleeve, a second wall of the flux sleeve and a third wall of the flux sleeve extending between the first wall and the second wall;

an armature disposed coaxially within an interior portion of the flux sleeve and supported for axial displacement between a first position when the coil is not energized and a second position when the coil is energized;

a pole piece at least partially disposed within an interior portion of the bobbin, the pole piece having a second radial surface substantially parallel to and abutting the first radial surface of the tubular flux sleeve;

a first non-magnetic armature stop coupled to the end of the pole piece, disposed between the armature and the pole piece, configured to prevent the armature from contacting the pole piece;

a first resilient member disposed in an axial bore, wherein a first end of the first resilient member is fixed against axial displacement and a second end of the first resilient member abuts the first non-magnetic armature stop; and a second resilient member disposed in the nozzle and in a compressed state when the coil is not energized and in an extended state when the coil is energized, wherein the first radial surface of the tubular flux sleeve and the second radial surface of the pole piece abut within the interior portion of the bobbin;

displacement of the armature from the first position to the second position displaces the second end of the first resilient member a corresponding amount; and the second resilient member in a compressed state urges the spool in a direction corresponding to the second position of the armature.

* * * * *